US008303262B1

(12) United States Patent
Hawkins

(10) Patent No.: US 8,303,262 B1
(45) Date of Patent: Nov. 6, 2012

(54) WHEELED, MANUALLY MOVEABLE TRASH PUMP

(76) Inventor: Bobby L. Hawkins, Travelers Rest, SC (US)

( * ) Notice: Subject to any disclaimer, the term of this patent is extended or adjusted under 35 U.S.C. 154(b) by 336 days.

(21) Appl. No.: 12/696,184

(22) Filed: Jan. 29, 2010

Related U.S. Application Data

(60) Provisional application No. 61/148,579, filed on Jan. 30, 2009, provisional application No. 61/151,276, filed on Feb. 10, 2009, provisional application No. 61/218,292, filed on Jun. 18, 2009, provisional application No. 61/231,816, filed on Aug. 6, 2009, provisional application No. 61/242,069, filed on Sep. 14, 2009.

(51) Int. Cl.
*F04B 53/00* (2006.01)
*F04B 17/05* (2006.01)

(52) U.S. Cl. ..... 417/234; 417/364; 280/6.155

(58) Field of Classification Search ..... 417/234, 417/364; 301/113; 280/6.154, 6.155, 6.156, 280/6.157, 47.24, 47.26, 124.116, 79.11, 280/79.3, 676, 677, 682, 124.11, 124.111, 280/6.15; 137/899, 899.4
See application file for complete search history.

(56) References Cited

U.S. PATENT DOCUMENTS

| | | | | | |
|---|---|---|---|---|---|
| 1,891,408 | A | * | 12/1932 | Gorman | 417/566 |
| 2,789,756 | A | * | 4/1957 | Allen | 137/899.4 |
| 2,812,041 | A | * | 11/1957 | Mugler | 188/74 |
| 2,812,895 | A | * | 11/1957 | Peeps | 137/899.4 |
| 3,424,440 | A | * | 1/1969 | Louis et al. | 366/47 |
| RE28,936 | E | * | 8/1976 | Talamantez | 280/5.2 |
| 4,063,849 | A | | 12/1977 | Modianos | |
| 4,129,402 | A | | 12/1978 | Eberhardt | |
| 4,419,048 | A | | 12/1983 | Pilachowski et al. | |
| D276,997 | S | * | 1/1985 | Mikado | D13/116 |
| 5,480,170 | A | * | 1/1996 | Kaiser, II | 280/30 |
| D420,773 | S | * | 2/2000 | Ertl et al. | D32/16 |
| 6,139,029 | A | * | 10/2000 | Shaw | 280/8 |
| 6,406,270 | B1 | * | 6/2002 | Kopel | 417/237 |
| 6,471,476 | B1 | | 10/2002 | Diels et al. | |
| 6,534,958 | B1 | * | 3/2003 | Graber et al. | 322/11 |
| 6,773,237 | B2 | * | 8/2004 | Burford et al. | 417/234 |
| 6,923,475 | B1 | * | 8/2005 | Martin et al. | 280/789 |
| D572,659 | S | * | 7/2008 | Hawkins | D13/116 |
| 7,475,888 | B2 | * | 1/2009 | Craig et al. | 280/47.18 |
| 7,490,847 | B2 | * | 2/2009 | Dahl | 280/638 |
| D597,944 | S | * | 8/2009 | Takamura | D13/116 |
| 2009/0284022 | A1 | * | 11/2009 | Usselman et al. | 290/38 R |

OTHER PUBLICATIONS

Owner'S Manual, Model TTP-300 3x3 Commercial Trash Pump, TITAN Industries, Revision #030321A.

* cited by examiner

*Primary Examiner* — Devon Kramer
*Assistant Examiner* — Nathan Zollinger
(74) *Attorney, Agent, or Firm* — Dority & Manning, P.A.

(57) ABSTRACT

A wheeled, manually movable, internal combustion engine powered trash pump is mounted in a rigid frame formed of tubular steel elements. A pair of aligned wheels is pivotally mounted independently to each opposite side of the frame. Each pair of aligned wheels is provided with a pivot pin mechanism that enables the rear wheels to be lifted off the ground to facilitate pivoting the unit on the front wheels. Each pair of aligned wheels is selectively detachable from the frame to facilitate shipping. The internal combustion engine is mounted toward the front end of the frame. The upper front portion of the frame houses a fuel tank completely within the outline of the frame, and the tank holds more than two gallons of fuel.

18 Claims, 19 Drawing Sheets

WHEELED, MANUALLY MOVEABLE TRASH PUMP

CROSS-REFERENCE TO RELATED APPLICATIONS

This application claims benefit to the following U.S. provisional patent applications: Ser. No. 61/148,579 filed Jan. 30, 2009; Ser. No. 61/151,276 filed Feb. 10, 2009; Ser. No. 61/218,292 filed Jun. 18, 2009; Ser. No. 61/231,816 filed Aug. 6, 2009; and Ser. No. 61/242,058 filed Sep. 14, 2009, the complete disclosures of each of the foregoing applications being hereby incorporated herein by this reference for all purposes.

STATEMENT REGARDING FEDERALLY SPONSORED RESEARCH OR DEVELOPMENT

N/A

BACKGROUND OF THE INVENTION

This application pertains to trash pumps that are powered by an internal combustion engine and that have wheels by which they can be moved manually.

Trash pumps are known, and many examples can be found, including the one described in U.S. Pat. No. 4,063,849, which by this reference is hereby incorporated herein for all purposes. Trash pumps powered by an internal combustion engine also are known, and many examples can be found, including those described in U.S. Pat. Nos. 4,129,402; 4,419,048 and 6,471,476; the complete disclosures of each of the foregoing patents being hereby incorporated herein by this reference for all purposes. But these pumps are stationary.

A typical wheeled trash pump is mounted in a frame, which carries both the pump and the internal combustion engine (whether powered by diesel fuel or gasoline) that powers the pump, and the fuel tank, which are the heaviest components. A pair of wheels can be rotatably mounted on an axle that typically will be mounted at one lower end of the front of the frame with a wheel on each opposite end of the axle that carries the front end of the frame and up to half the weight of the trash pump unit. Opposite the trash pump end of the frame having the axle and wheels, the rear end of the frame typically will have a pair of stationary vertical support legs to carry the other portion of the weight of the trash pump unit.

A rear handle typically will be mounted on the upper portion of the rear of the frame opposite the end of the frame where the wheels are mounted. The handle typically will be stationary and can be used to lift the stationary end of the frame and pull or push the trash pump unit on the two wheels at the front end of the frame.

OBJECTS AND SUMMARY OF THE INVENTION

It is a principal object of the present invention to provide an improved wheeled, manually movable, internal combustion engine powered trash pump unit that can operate continuously for about two and one-half hours on a single tank of fuel.

It is another principal object of the present invention to provide a wheeled, manually movable, internal combustion engine powered trash pump unit capable of being moved off-road to negotiate across relatively rough terrain.

It is a further principal object of the present invention to provide an improved wheeled, manually movable, internal combustion engine powered trash pump unit that quickly and easily can be partially disassembled for ease of shipment and storage and re-assembled once arriving on site for operation.

Additional objects and advantages of the invention will be set forth in part in the description that follows, and in part will be obvious from the description, or may be learned by practice of the invention. The objects and advantages of the invention may be realized and attained by means of the instrumentalities and combinations particularly pointed out in the description below.

To achieve the objects and in accordance with the purpose of the invention, as embodied and broadly described herein, a wheeled, manually movable, internal combustion engine powered (e.g., diesel or gasoline engine powered) trash pump is mounted in a rigid frame formed of tubular steel elements.

A pair of aligned wheels is pivotally mounted to each opposite side of the frame such that the pivot point will be disposed between the front end of the frame and the center of gravity of the overall unit. Each pair of aligned wheels quickly and easily can be disassembled from the frame for ease of shipment and storage and quickly and easily re-assembled to the frame once arriving on site for operation. Each of the ends of the rear legs on the rear edge of the main floor panel of the trash pump unit's frame desirably carries a support cushion that enables one trash pump unit to be stacked on top of another trash pump unit during shipping and storage.

A retractable twin grip handle desirably is mounted to the upper portion of the rear end of the frame to facilitate pulling the trash pump unit past obstacles that rise above or dip below level terrain. A lifting pivot pin desirably can be provided on each of the left and right wheel supports to facilitate lifting the rearwardly facing wheels in order to negotiate elevated obstacles and to facilitate pivoting the trash pump unit left and right on the frontmost wheels. A retractable front handle desirably is mounted to the upper portion of the front end of the frame to facilitate lifting the trash pump unit past obstacles that cannot be negotiated with the wheels.

The internal combustion engine (diesel or gasoline) and the pump desirably are mounted on a main floor panel that is carried by the frame. The internal combustion engine desirably is mounted toward the front end of the frame above the two pairs of aligned wheels, and the pump desirably is mounted toward the rear end of the frame. The fuel tank desirably is mounted above the engine and has a fill cap on top of the fuel tank. The fill cap desirably has a mechanism to lock the cap to the fuel tank. The upper front portion of the frame houses the fuel tank completely within the outline of the frame, and the upper surface of the fuel tank desirably is disposed beneath the uppermost elements of the frame.

The accompanying drawings, which are incorporated in and constitute a part of this specification, illustrate at least one presently preferred embodiment of the invention as well as some alternative embodiments. These drawings, together with the description, serve to explain the principles of the invention but by no means are intended to be exhaustive of all of the possible manifestations of the invention.

DETAILED DESCRIPTION OF THE PREFERRED EMBODIMENTS

Reference now will be made in detail to the presently preferred embodiments of the invention, several examples of which being illustrated in the accompanying drawings. Each example is provided by way of explanation of the invention, which is not restricted to the specifics of the examples. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of what could be claimed and equivalents thereof. The same numerals are assigned to the same components throughout the drawings and description.

Figure 1:
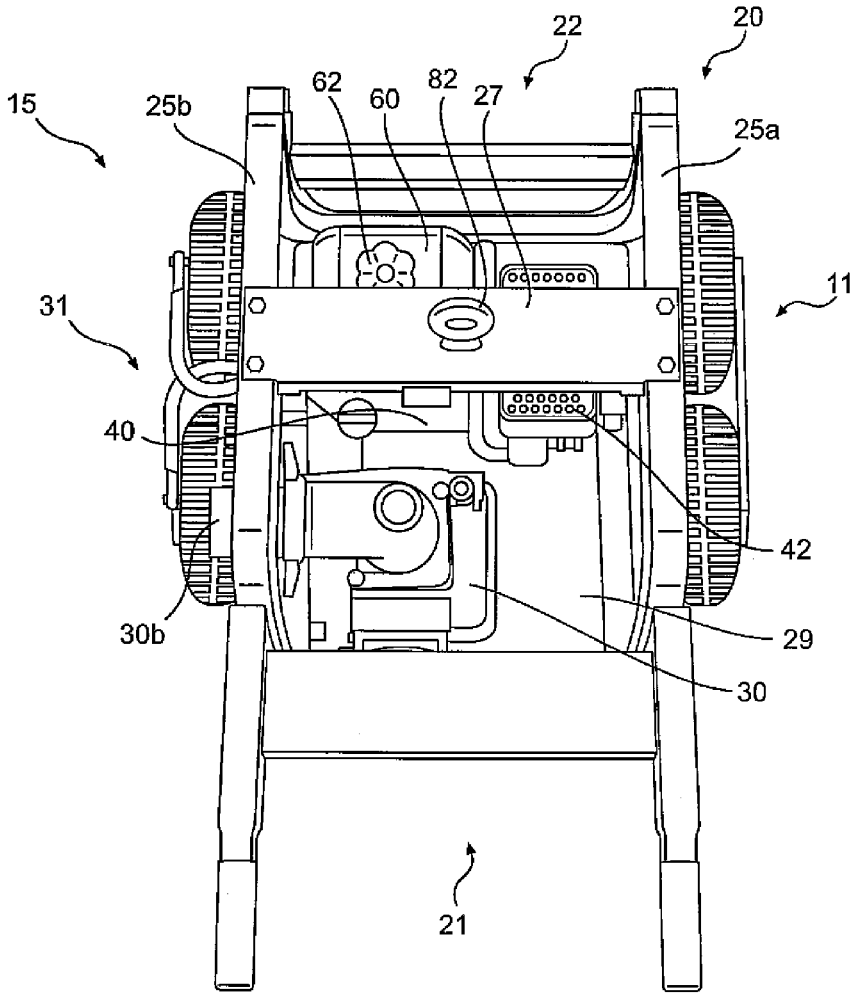
FIG. 1 is an elevated perspective view from above the rear end of a presently preferred embodiment of the wheeled, manually movable, internal combustion engine powered trash pump of the present invention.
Figure 2:
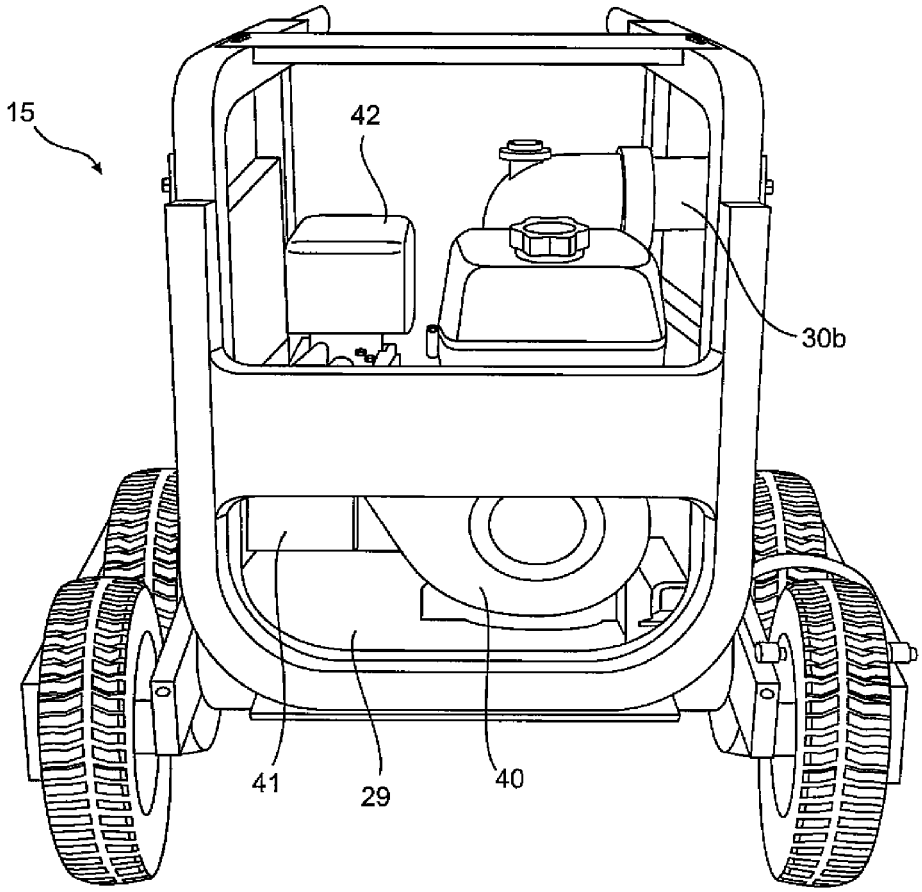
FIG. 2 is a perspective view of the front end of a presently preferred embodiment of the wheeled, manually movable, internal combustion engine powered trash pump of the present invention.

One of the presently preferred embodiments of the wheeled, manually movable, internal combustion engine powered trash pump unit is shown in FIG. 1 and is represented generally by the numeral 15. The wheeled, manually movable, internal combustion engine powered trash pump unit 15 desirably can include a rigid frame generally designated by the numeral 20, a pump 30, an internal combustion engine 40 that powers the pump 30, a fuel tank 60 for the engine 40, an exhaust muffler 42 for the engine 40, and a pair of dual wheel assemblies 11, 31. As shown in FIG. 2, the trash pump unit 15 also desirably can include an air filter for the engine 40, which desirably is provided by a six horsepower gasoline fueled internal combustion engine. The pump 30 desirably can move 15,840 gallons of water per hour between the pump's inlet 30*a* outlet 30*b*, which are identified in FIG. 3 for example.

Figure 3:
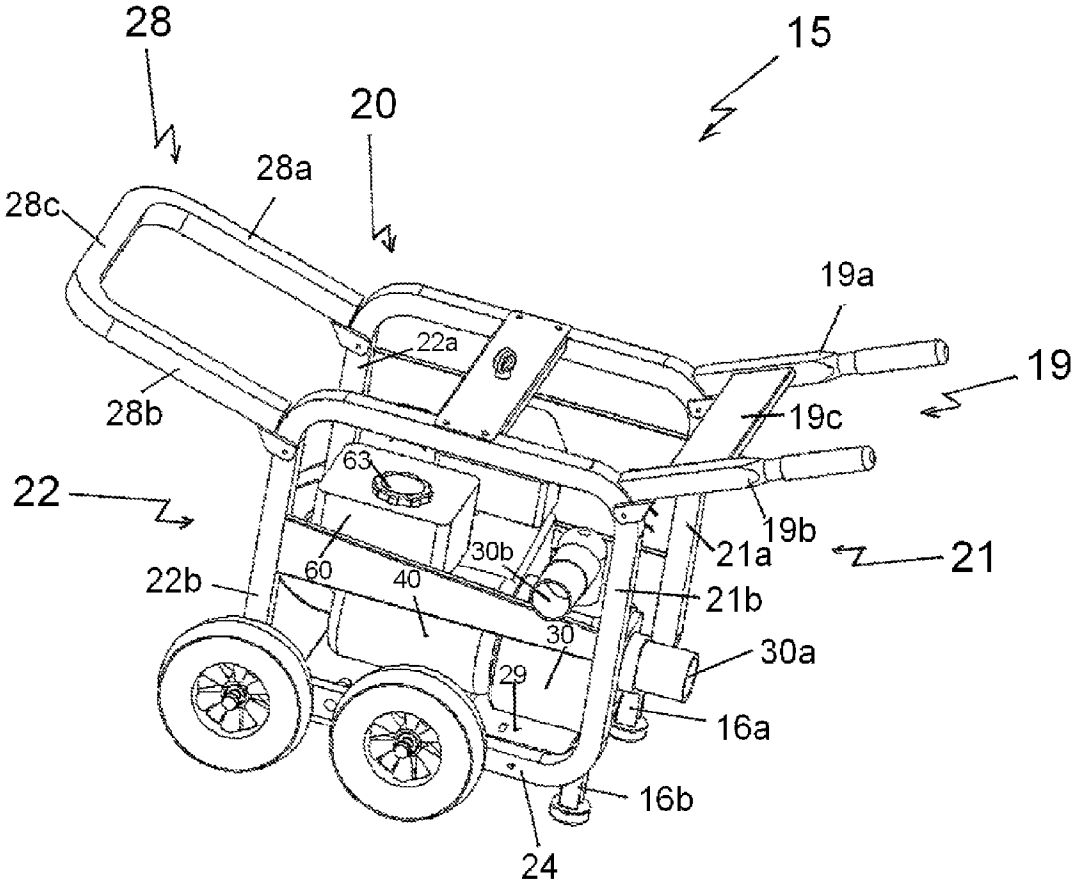
FIG. 3 is an elevated perspective view of the left side of a partially assembled, presently preferred embodiment of the wheeled, manually movable, internal combustion engine powered trash pump of the present invention.

The frame 20 desirably is formed of 16 gauge tubular steel elements. In the views shown in FIGS. 3, 7-11, 14 and 15, some of the components of the wheeled, manually movable, internal combustion engine powered trash pump unit 15 are shown pulled away from the frame 20. As shown in FIGS. 1 and 3, the frame 20 desirably is divided into a rear end 21 and a front end 22 disposed opposite the rear end 21. The frame's longest dimension is the frame's length, and the frame's length elongates in the frame's longitudinal or axial direction between the rear end 21 and the front end 22. When the trash pump unit 15 is resting on the ground on the frame's rear legs 16*a*, 16*b* and on the wheels of the trash pump unit 15 as in FIG. 3 for example, the frame's height is the frame's measurement in the vertical direction above the ground. The remaining rectilinear measurement of the frame is the frame's width, which is measured orthogonally with respect to the frame's length and height and extends in the transverse direction.

Figure 4:
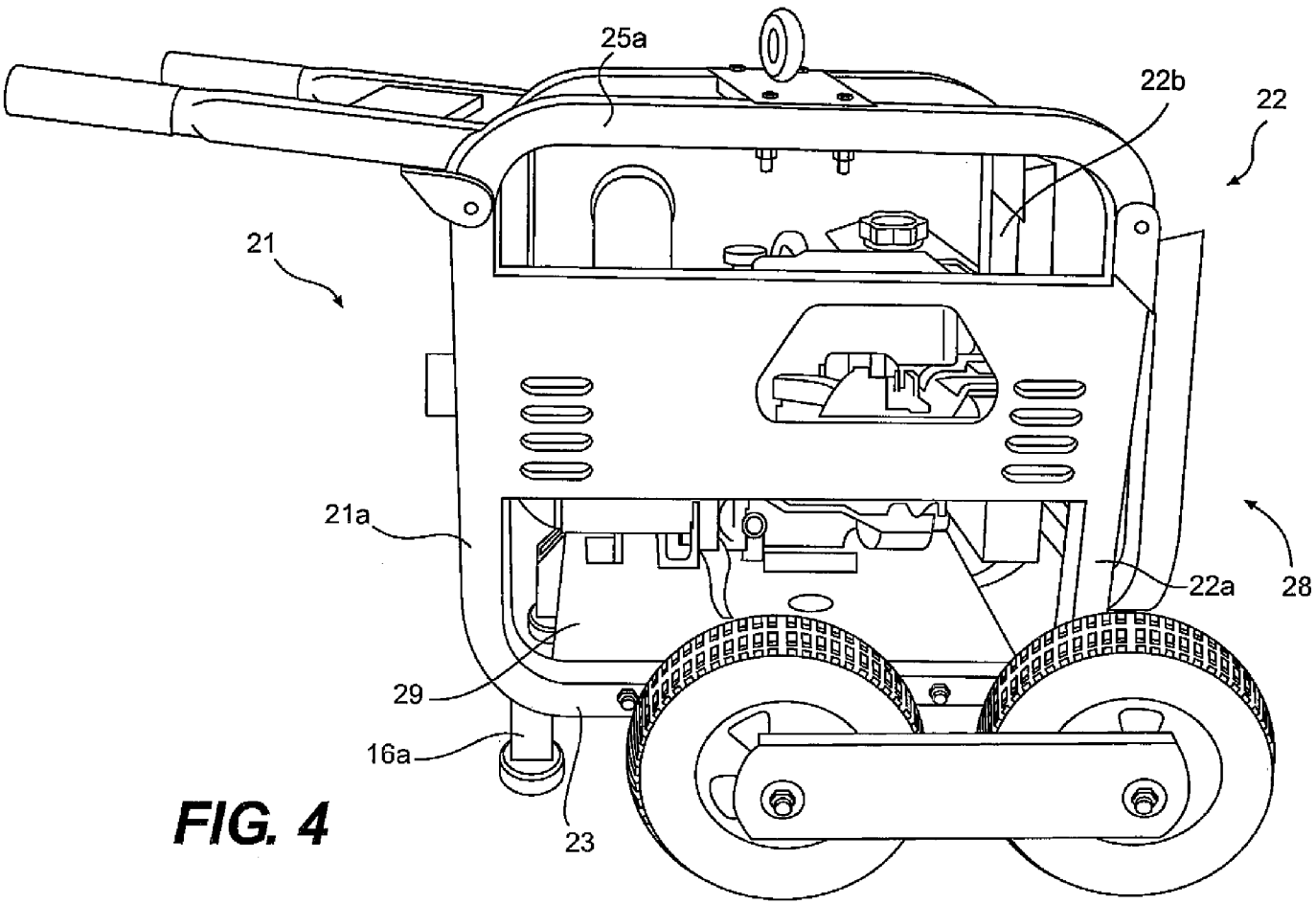
FIG. 4 is an elevated perspective view of the right side of a presently preferred embodiment of the wheeled, manually movable, internal combustion engine powered trash pump of the present invention.
Figure 15:
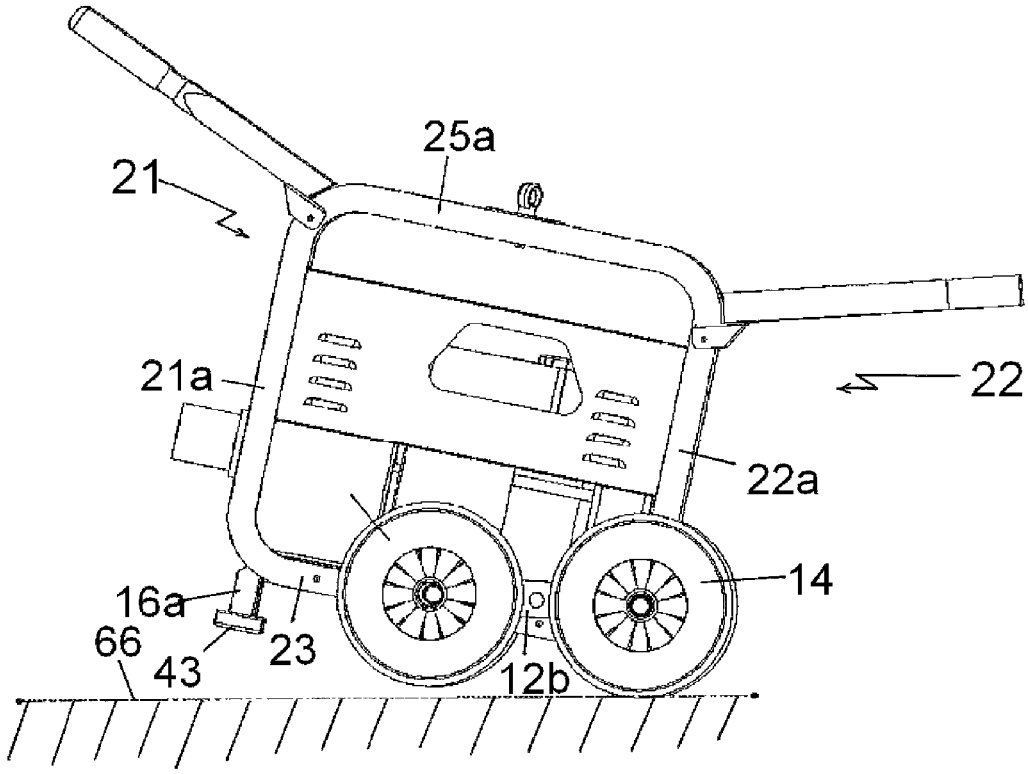
FIG. 15 is a plan view from the right side of components of a partially assembled embodiment of the wheeled, manually movable, internal combustion engine powered trash pump unit of the present invention.

As shown in FIGS. 4 and 15, the lower portion of the frame desirably includes a right bottom rail 23 having a rear end connected to or unitary with a lower end of a right rear upright member 21*a*, which has an upper end connected to or unitary with the rear end of a right top rail 25*a*. The opposite or front end of the right top rail 25*a* desirably can be connected to or unitary with the upper end of a right front member 22*a*, and the opposite or lower end of the right front member 22*a* desirably can be connected to or unitary with the front end of the right bottom rail 23.

Figure 5:
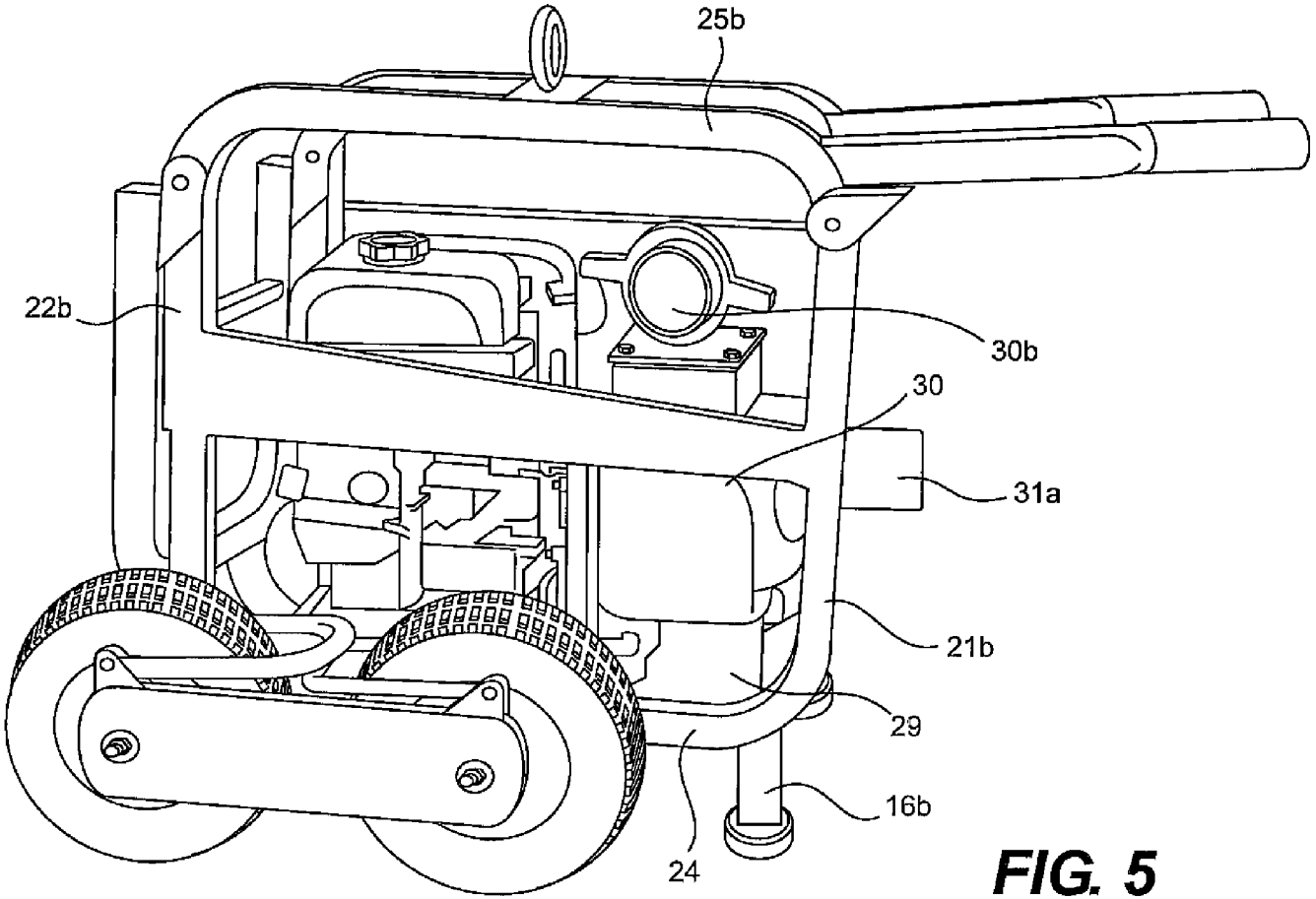
FIG. 5 is an elevated perspective view of the left side of a presently preferred embodiment of the wheeled, manually movable, internal combustion engine powered trash pump of the present invention.
Figure 14:
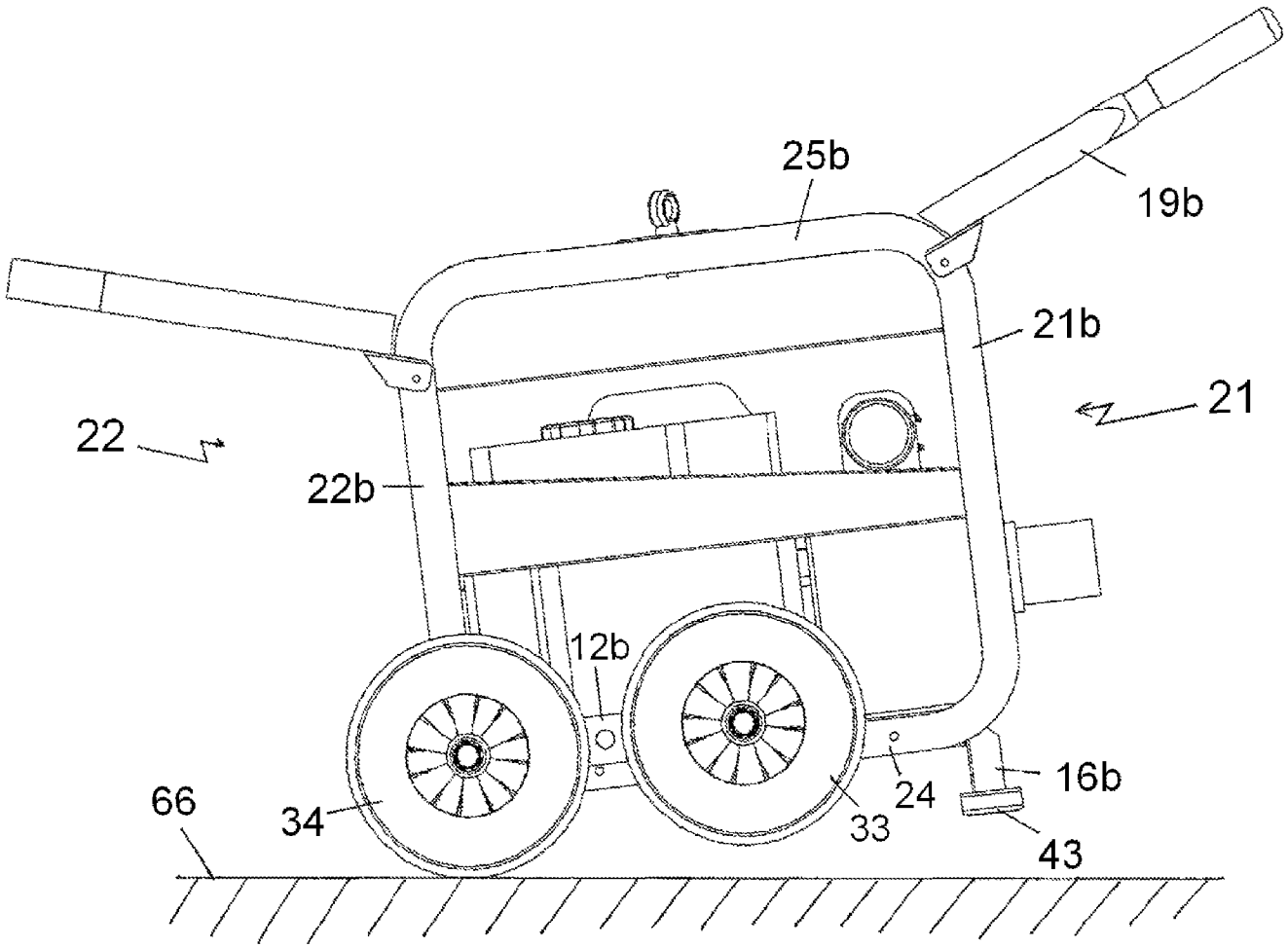
FIG. 14 is a plan view from the left side of components of a partially assembled embodiment of the wheeled, manually movable, internal combustion engine powered trash pump unit of the present invention.

As shown in FIGS. 3, 5 and 14, the lower portion of the frame can include a left bottom rail 24 having a rear end connected to or unitary with the lower end of a left rear upright member 21*b*, which has an upper end connected to or unitary with the rear end of a left top rail 25*b*. The front end of the left top rail 25*b* desirably can be connected to or unitary with the upper end of a left front member 22*b*, and the opposite or lower end of the left front member 22*b* desirably can be connected to or unitary with the front end of the left bottom rail 24.

As shown in FIG. 3 for example, a retractable, rear handle 19 is pivotally mounted to be extendable from the upper portion of the rear end 21 of the frame 20. The rear handle 19 can include at least one cross brace 19*c* connecting a right grip handle 19*a* that extends parallel to and spaced apart from a left grip handle 19*b*. As shown in FIG. 3 for example, one end of the right grip handle 19*a* is pivotally mounted to the upper end of the right rear upright member 21*a* of the frame, and one end of the left grip handle 19*b* is pivotally mounted to the upper end of the left rear upright member 21*b* of the frame. Though not shown in FIG. 3, the rear handle 19 can be retracted from its fully horizontally extended orientation (shown in FIG. 3) to a position (not shown in FIG. 3) whereby the rear handle 19 lies flush with the rear end 21 of the frame 20, and the right grip handle 19*a* rests against the right rear upright member 21*a* and the left grip handle 19*b* rests against the left rear upright member 21*b*. The ability of the handle 19 to assume the fully retracted position against the rear end 21 of the frame 20 facilitates storage of an individual trash pump unit 15 and shipment of multiple trash pump units 15 together.

Figure 6:
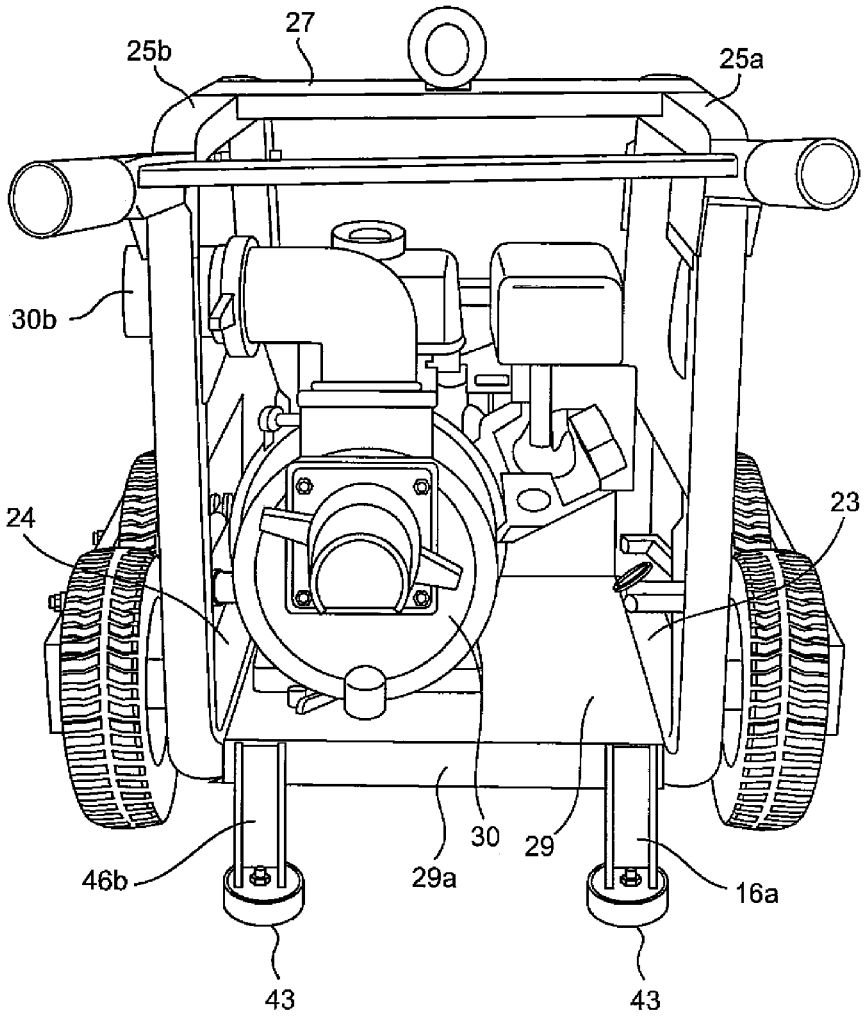
FIG. 6 is a perspective view of the rear end of a presently preferred embodiment of the wheeled, manually movable, internal combustion engine powered trash pump of the present invention.
Figure 7:
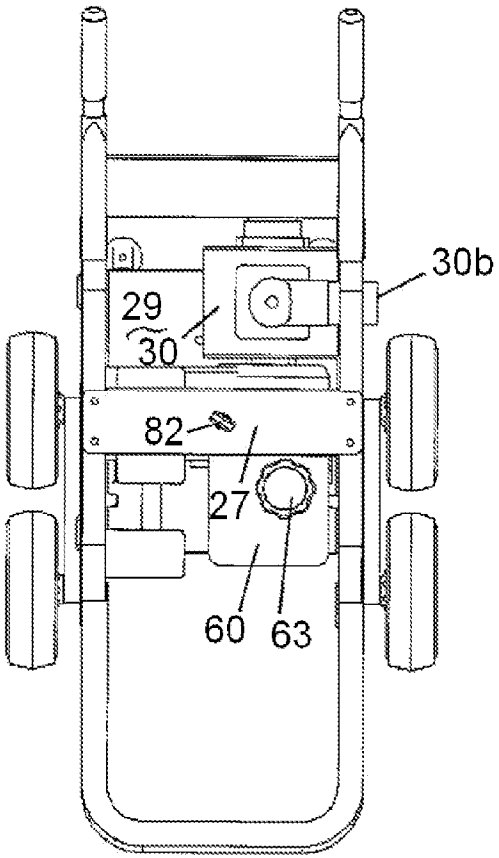
FIG. 7 is a plan view from above a partially assembled, presently preferred embodiment of the wheeled, manually movable, internal combustion engine powered trash pump of the present invention.
Figure 8:
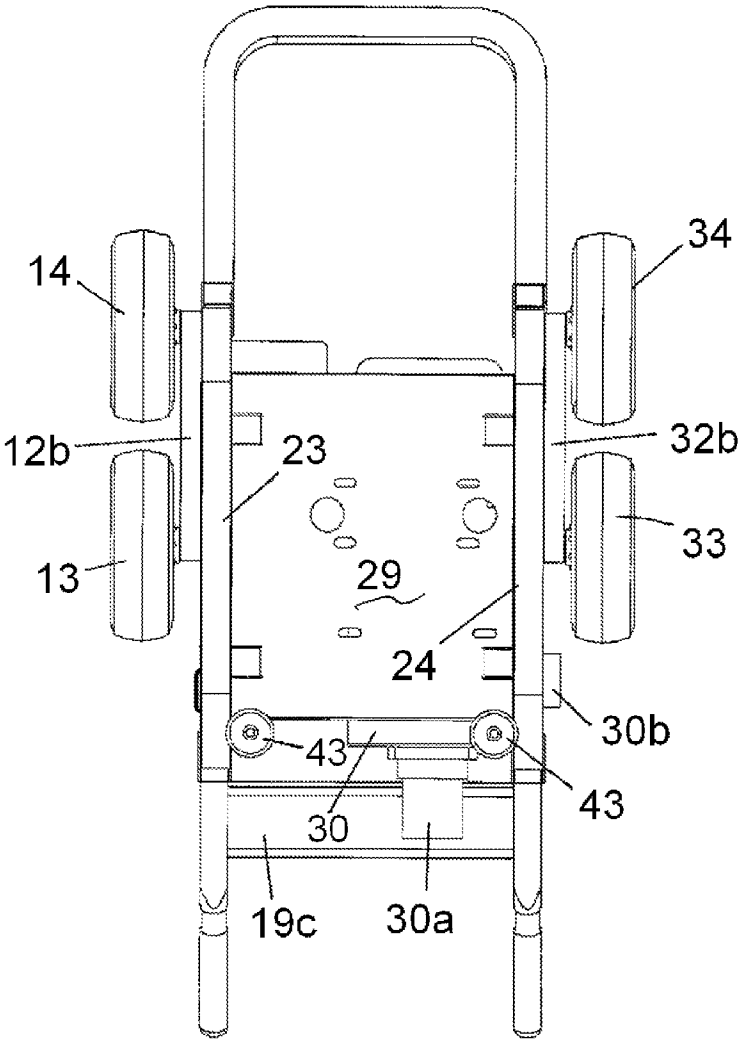
FIG. 8 is a plan view from beneath a partially assembled, presently preferred embodiment of the wheeled, manually movable, internal combustion engine powered trash pump of the present invention.

As shown in the perspective view of FIGS. 1, 2 and 6, the top plan view of FIG. 7 and the bottom plan view of FIG. 8, the frame desirably can include a main floor panel 29. As shown in the rear perspective view of FIG. 6 and the bottom plan view of FIG. 8, the main floor panel 29 desirably has a right edge connected to the right bottom rail 23 and a left edge connected to the left bottom rail 24. As shown in the perspective view of FIG. 1, the main floor panel 29 carries the internal combustion engine 40 and the pump 30. As shown in FIG. 1, the internal combustion engine 40 and the fuel tank 60 desirably are mounted toward the front end 22 of the frame 20 and above the two wheel assemblies 11, 31, and the pump 30 of the trash pump unit 15 desirably is mounted toward the rear end 21 of the frame 20 between the wheel assemblies 11, 31 and the rear legs 16. As shown in FIG. 2 for example, the main floor panel 29 also carries the engine's air filter 41.

As shown in FIG. 6, the upper end of the right rear leg 16*a* is connected (as by welding or by selectively detachable mechanical fasteners for example) to the right side of the rear edge 29*a* of the main floor panel 29, and the upper end of the left rear leg 16*b* is connected to the left side of the rear edge 29*a* of the main floor panel 29. As shown in FIG. 6 for example, each rear leg 16*a*, 16*b* desirably is provided with a support cushion 43 fixed at the free end of each rear leg 16*a*, 16*b*. During shipping of multiple trash pump units 15, it is desirable to be able to rest one trash pump unit 15 on top of another trash pump unit 15 without fear that the trash pump unit 15 underneath will become damaged by the trash pump unit 15 stacked above. Moreover, it is desirable that such stacking can be effected without fear that the trash pump unit 15 stacked above will slide with respect to the trash pump unit 15 stacked below. Accordingly, each support cushion 43 desirably is formed of resilient, high friction material to rest against the upper frame of a trash pump unit 15 stacked underneath.

Figure 10:
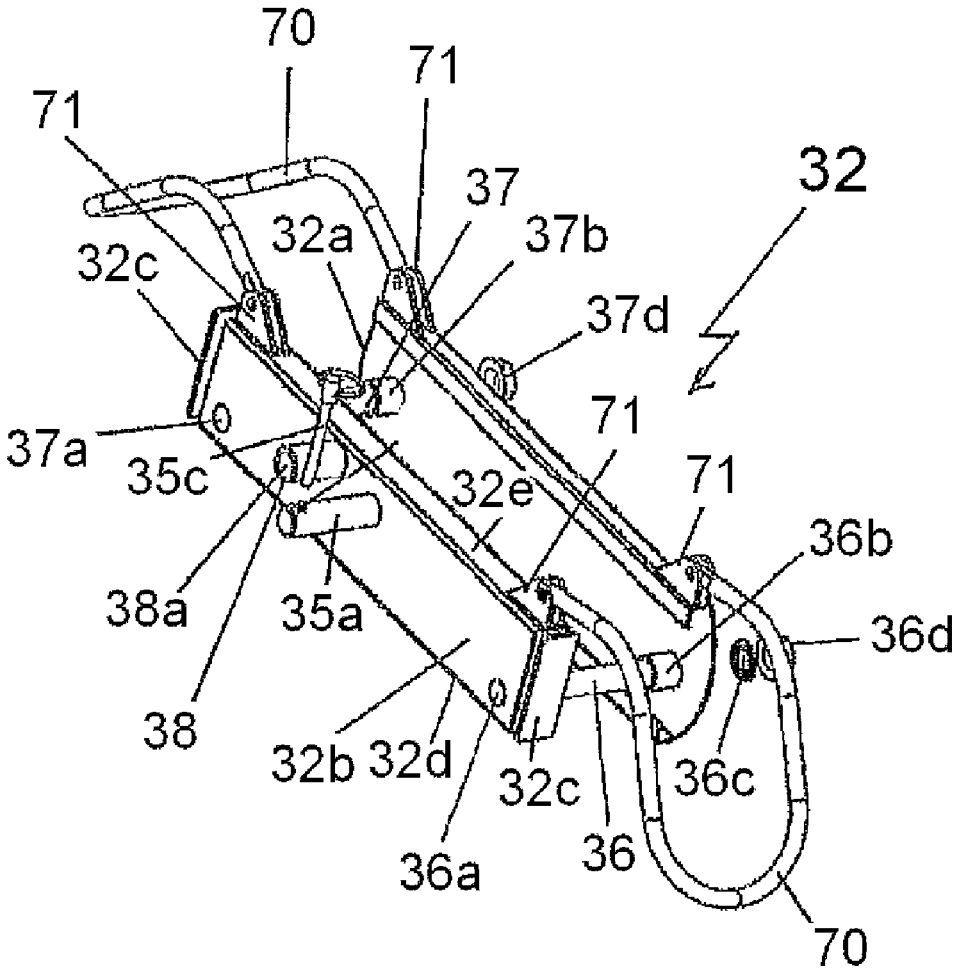
FIG. 10 is an elevated perspective view of an assemblage of components of an embodiment of a wheel assembly of a presently preferred embodiment of the wheeled, manually movable, internal combustion engine powered trash pump of the present invention.

The right wheel assembly 11 and the left wheel assembly 31 are mirror images of each other, and thus for the sake of brevity, most of the detailed description will be directed to the left wheel assembly 31. FIG. 10 illustrates an elevated perspective view of a left wheel support 32 before the wheels are attached and before the left wheel support 32 is pivotally attached to the lower left rail 24 of the frame 20. As shown in FIG. 10 for example, a left wheel support 32 desirably includes an outer left wheel support 32*a* and an inner left wheel support 32*b*. The inner left wheel support 32*b* desirably can be formed by a length of rectangular cross-section extrusion of 18 gauge cold rolled, tubular steel having about a 60,000 psi rating. As shown in FIG. 10, each opposite end of the inner left wheel support 32*b* desirably can be sealed by an end cap 32*c* that is press fit onto the open end of the tubular extrusion that desirably forms the inner left wheel support 32*b*, and the end cap 32*c* desirably is formed of plastic or rubber. As shown in FIG. 10 for example, in a presently preferred embodiment, the inner left wheel support 32*b* has a height of about three inches measured between the lower edge 32*d* and the upper edge 32*e*, a length of about thirteen and three-quarters inches measured between the opposite ends, and a thickness or depth of about one inch measured orthogonally with respect to each of the height and length.

As shown in FIG. 10 for example, one end 36*a* of a front wheel axle 36 can be permanently attached (as by welding for example) to the inner left wheel support 32*b*, and one end 37*a* of a rear wheel axle 37 can be permanently attached (as by welding for example) to the inner left wheel support 32*b*. In a presently preferred embodiment, each wheel axle 36, 37 desirably is made of steel and has a diameter of about five-eighths of an inch, and the central axis of rotation of each wheel axle 36, 37 desirably is disposed about five-eighths of an inch above the lower edge 32*d* of the inner left wheel support 32*b* and the central axes of the two wheel axles 36, 37 desirably are spaced about twelve and three-eighths inches apart and centered with respect to the ends of the inner left wheel support 32*b*.

Figure 9:
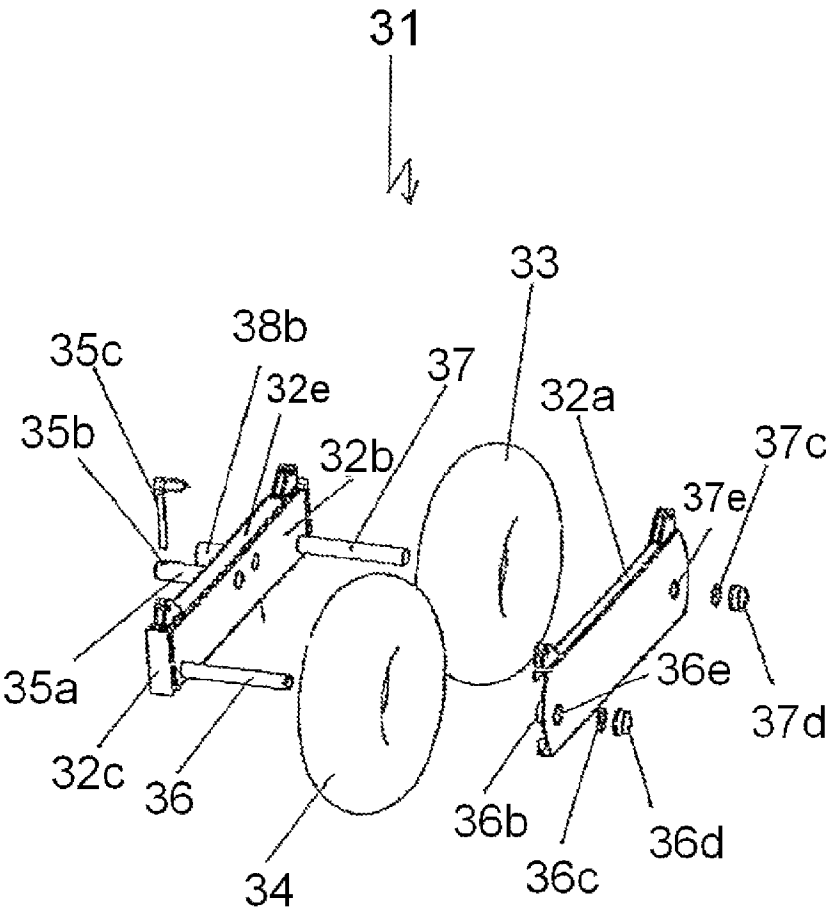
FIG. 9 is an elevated perspective view of an assemblage of components of an embodiment of a wheel assembly of a presently preferred embodiment of the wheeled, manually movable, internal combustion engine powered trash pump of the present invention.

FIG. 9 illustrates disassembled components of a left wheel assembly 31 before the wheels 33, 34 are attached and before the inner left wheel support 32*b* is pivotally attached to the lower left rail 24 of the frame 20. As shown in the perspective view of FIG. 9 for example, components of a left wheel assembly 31 can include two left wheels 33, 34 rotatably mounted to the inner left wheel support 32*b*. In a presently preferred embodiment, each wheel 33, 34 is formed of solid rubber and has a diameter of about ten inches and a tread that is about three and three-eighths of an inch wide. As shown in FIG. 9 for example, the two left wheels include a front left wheel 34 that is rotatably disposed on the front wheel axle 36 and a rear left wheel 33 that is rotatably disposed on the rear wheel axle 37. The front left wheel 34 and the rear left wheel 33 desirably are aligned with each other such that the axis of rotation of each wheel 33, 34 is spaced apart from and parallel to the axis of rotation of the other wheel 33, 34 in the left wheel assembly 31.

As shown in FIGS. 9 and 10 for example, a left wheel assembly axle 35*a* can be mounted permanently (as by welding for example) to the inner left wheel support 32*b*. In a presently preferred embodiment, the left wheel assembly axle 35*a* has a diameter of about three-quarters of an inch and the central axis of rotation of the left wheel assembly axle 35*a* is disposed about two inches above the lower edge 32*d* of the inner left wheel support 32*b*. In a presently preferred embodiment, the central axis of rotation of the left wheel assembly axle 35*a* is disposed equidistantly from each of the opposed ends of the inner left wheel support 32*b*. In a presently preferred embodiment, the central axis of rotation of the left wheel assembly axle 35*a* is disposed equidistantly from each of the axes of rotation of the front and rear axles 36, 37, which desirably are spaced apart at their central axes by about a foot. In a presently preferred embodiment, the central axes of rotation of the left wheel assembly axle 35*a* and the two wheel axles 36, 37 form an isosceles triangle in the plane of the inner left wheel support 32*b* as well as in any plane passing through all three axes in a manner normal to those axes.

Referring to FIGS. 9 and 10 for example, to assemble the left wheel assembly 31 for example, the front wheel axle 36 is passed through the front wheel bearing of the front wheel 34. The front axle 36 then is inserted through the front axle sleeve 36*b* (FIG. 10), which desirably forms part of and projects from the inner surface of the outer left wheel support 32*a*, and then through the aligned concentric opening 36*e* in the outer left wheel support 32*a*. The free end of the front axle 36 is then secured by a fastener 36*c*, which desirably can be a washer that is press-fit onto the free end of the front axle 36. The free end of the front wheel axle 36 can be covered with a cap 36*d*. The same procedure can be followed for the rear wheel 33, the rear wheel axle 37, the rear axle sleeve 37*b* and concentric opening 37*e* in the outer left wheel support 32*a*, the fastener 37*c* for the free end of the rear wheel axle 37, and a cap 37*d*. When the components of the left wheel assembly 31 in FIG. 9 are fully assembled, a presently preferred embodiment of the left wheel assembly 31 desirably weighs about fifteen pounds. Alternatively, as shown in FIGS. 4 and 5 for example, the outer left wheel support 32*a* and outer right wheel support 12*a* can be eliminated from the respective left wheel assembly 31 and right wheel assembly 11.

When the left wheel assembly 31 is so assembled, the axes of rotation of the front and rear axles 36, 37 are perpendicular to the parallel planes that define the outer left wheel support 32*a* and the inner left wheel support 32*b* and parallel to the axis of rotation of the left wheel assembly axle 35*a*. Moreover, as shown in FIGS. 6 and 9 for example, the front left wheel 34 and the rear left wheel 33 desirably are aligned with each other such that the axis of rotation of each wheel is spaced apart from and parallel to the axis of rotation of the other wheel in the left wheel assembly 31.

Figure 11:
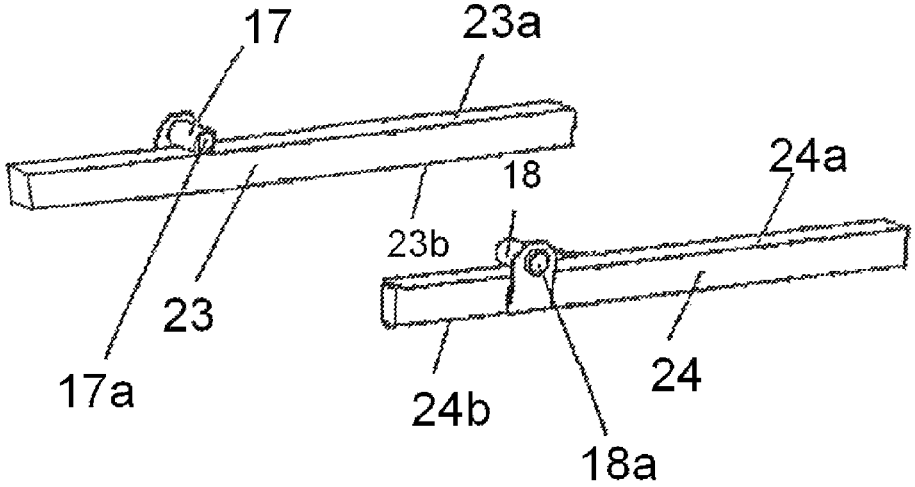
FIG. 11 is an elevated perspective view of the left and right lower rails of a presently preferred embodiment of the wheeled, manually movable, internal combustion engine powered trash pump of the present invention.
Figure 12A:
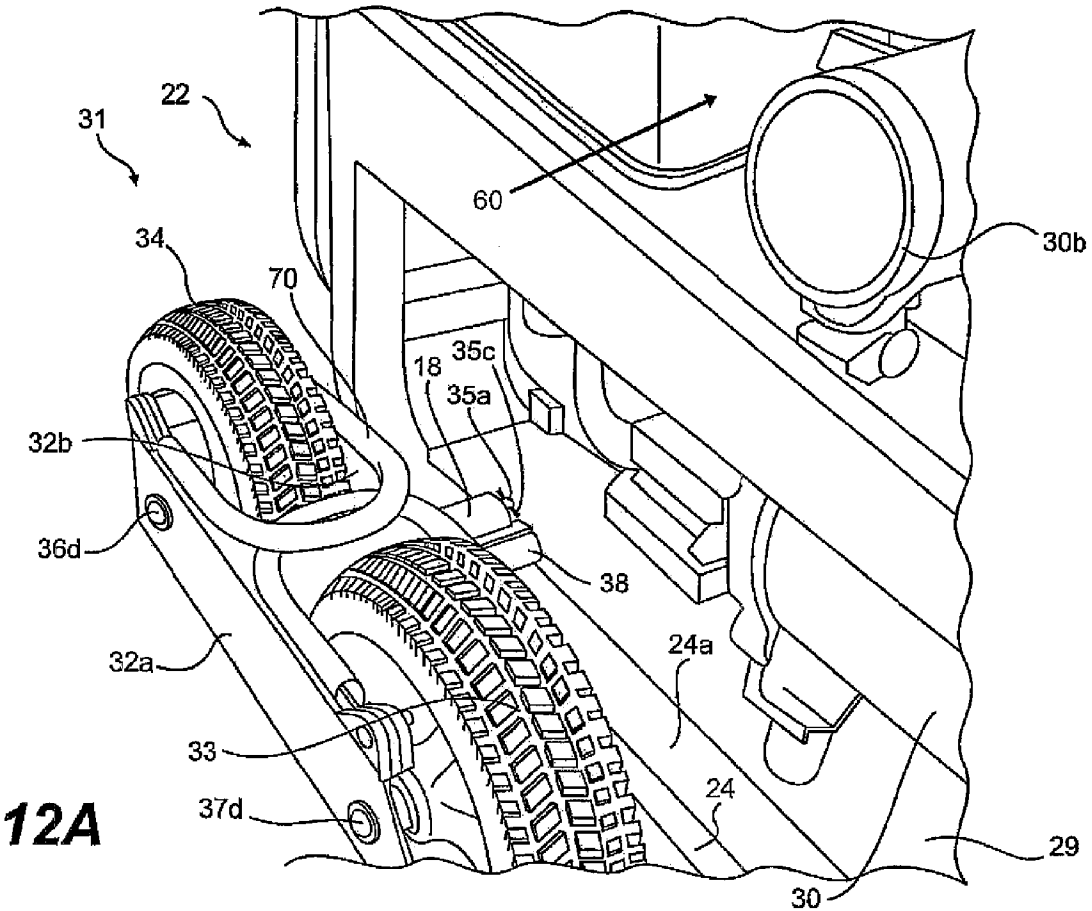
FIG. 12A is an elevated perspective view of the front left side of a section of a presently preferred embodiment of the wheeled, manually movable, internal combustion engine powered air compressor of the present invention.

As shown in FIGS. 11 and 12A for example, a left wheel bearing 18 is formed by a hollow cylindrical section of a stainless steel tube that is rigidly and permanently mounted (as by welding for example) to the upper surface 24*a* of the left bottom rail 24 at the lower portion of the left side of the frame 20. The left wheel bearing 18 defines a cylindrically shaped opening 18*a* that is configured to rotatably receive therein the left wheel assembly axle 35*a* of the left wheel support 32. In this way, as shown in FIG. 12A for example, the left wheel assembly 31 desirably is pivotally mounted to the lower left side of the frame 20 toward the front end 22 of the frame so that the left wheel assembly 11 is constrained to pivot in a manner that maintains the two left wheels in the same plane during the pivoting movement.

Figure 12B:
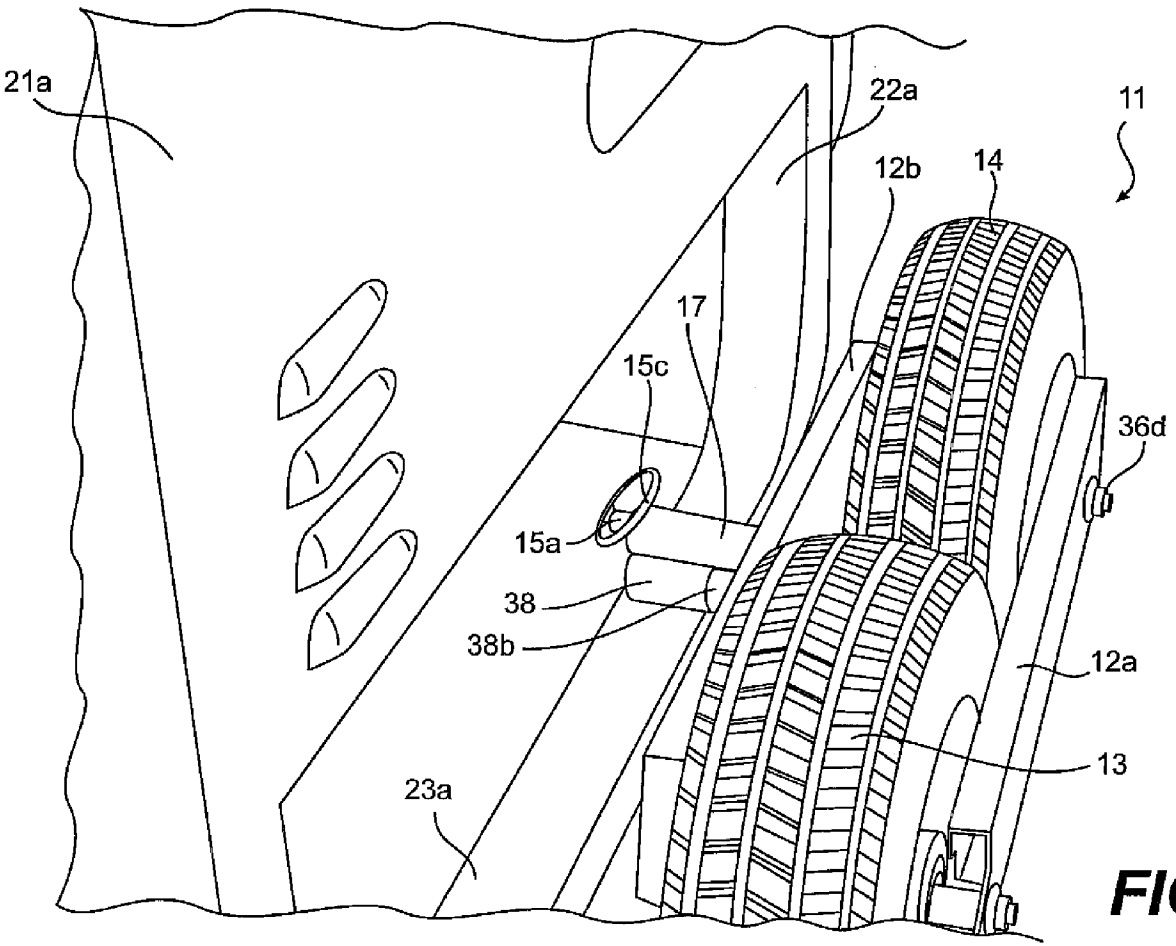
FIG. 12B is an elevated perspective view of the front right side of a section of a presently preferred embodiment of the wheeled, manually movable, internal combustion engine powered air compressor of the present invention.
Figure 13:
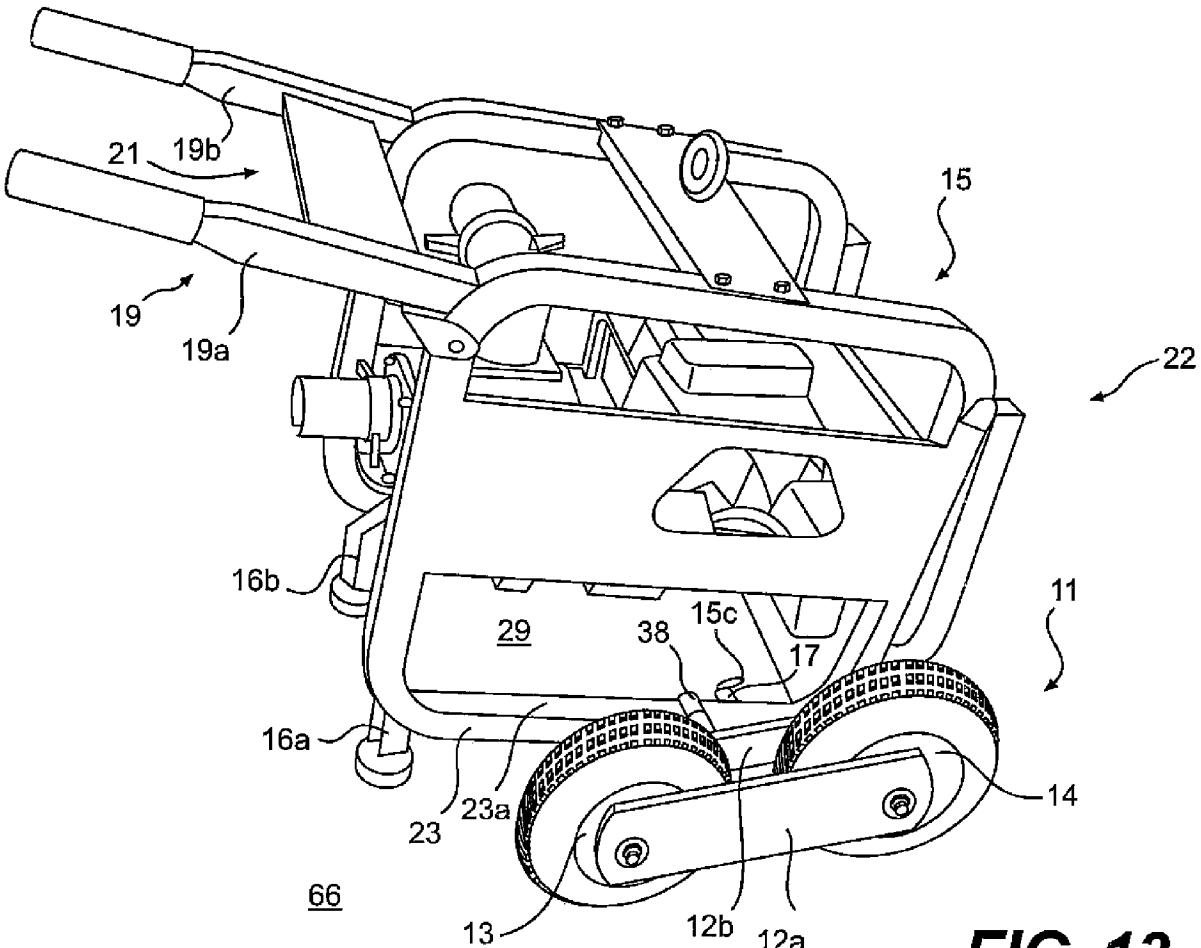
FIG. 13 is an elevated perspective view from the rear right side of a presently preferred embodiment of the wheeled, manually movable, internal combustion engine powered trash pump unit of the present invention.

As similarly shown in FIGS. 11 and 12B, a right wheel bearing 17 is formed by a hollow cylindrical section of a stainless steel tube that is rigidly and permanently mounted (as by welding for example) to the upper surface 23*a* of the right bottom rail 23 at the lower portion of the right side of the frame 20. The right wheel bearing 17 defines a cylindrically shaped opening 17*a* that is configured to rotatably receive therein the right wheel assembly axle 15*a* of the inner right wheel support 12*b*. In this way, the right wheel assembly 11 desirably is pivotally mounted to the lower right side of the frame 20 toward the front end 22 of the frame so that the right wheel assembly 11 is constrained to pivot in a manner that maintains the two right wheels in the same plane during the pivoting movement.

A quick-disconnect member desirably is selectively connected to each wheel assembly and configured to selectively permit quickly disconnecting each respective wheel assembly from one side of the frame. As shown in FIG. 9, a hole 35*b* is defined through the left wheel assembly axle 35*a* near the free end thereof, and the hole 35*b* is configured to receive therein a quick-disconnect member in the form of a cotter pin 35*c*. As shown in FIG. 12A, after the left wheel assembly axle 35*a* of the inner left wheel support 32*b* is inserted through the opening 18*a* in the left wheel bearing 18, the cotter pin 35*c* is inserted through the hole 35*b* to complete the rotational attachment of the inner left wheel support 32*b* of the left wheel assembly 31 to the lower left rail 24 of the frame 20. As shown in FIG. 12B for example, a cotter pin 15*c* similarly is used to complete the rotational attachment of the right wheel assembly axle 15*a* of the inner right wheel support 12*b* of the right wheel assembly 11 to the right bottom rail 23 of the frame 20. In this way, the user's selective removal or insertion of the cotter pin 15*c* or 35*c* either releases or secures the respective wheel assembly axle 15*a*, 35*a* and accordingly provides for quick disassembly or assembly, respectively, of the respective wheel assembly 11, 31 from and to the frame 20 for ease of shipping and ease of re-assembly after shipping.

With reference to FIGS. 3, 11, 12A, 12B and 13 for example, the respective right wheel bearing 17 that rotatably receives the right wheel assembly axle 15*a* of the right wheel assembly 11 and the left wheel bearing 18 that rotatably receives and supports the left wheel assembly axle 35*a* of the left wheel assembly 31 will be disposed between the front end 22 of the frame 20 and the center of gravity of the overall unit 15, whether the trash pump's fuel tank 60 is full or empty. In a presently preferred embodiment, the central axis of the opening 17*a* defined by the right wheel bearing 17 desirably is disposed about six and five-eighths inches from the front edge of the right front member 22*a* of the frame 20 and about seventeen and one-half inches from the rear edge of the right rear upright member 21*a* of the frame 20. The preferred disposition of the central axis of the opening 18*a* is the mirror image of the location of the central axis of the opening 17*a*. With these locations of the right and left wheel assembly sleeve bearings 17, 18, each of the right wheel assembly 11 and left wheel assembly 31 will become pivotally mounted to the frame 20 such that the pivot points at the centers of the axes of rotation of the respective wheel assembly axles 15*a*, 35*a* facilitate maneuvering over rough terrain with a full tank of fuel without fear of the trash pump unit 15 tipping over the front wheels 14, 34. Moreover, each of the right wheel assembly 11 and the left wheel assembly 31 desirably pivots independently of the other wheel assembly. Thus, each of the right wheel assembly 11 and left wheel assembly 31 can negotiate independently of each other over relatively raised obstructions or through depressions in the path.

As shown in FIG. 9, a short length of cylindrical steel tubing can be disposed as a left side pivot pin 38*a* having one opposite end mounted (as by welding for example) to the inner left wheel support 32*b* and extending in the same direction as and parallel to the left wheel assembly axle 35*a*. The left side pivot pin desirably 38*a* has a diameter of about one half inch. As shown in FIGS. 10 and 12A, the left side pivot pin 38*a* desirably is surrounded by a cylindrically shaped rubber sleeve 38 such that the combined diameter of the left side pivot pin 38*a* and sleeve 38 is about one inch. Similarly, as shown in FIG. 12B, a right side pivot pin 38*b* has one opposite end mounted (as by welding for example) to the inner right wheel support 32*b* and extending in the same direction as and parallel to the right wheel assembly axle 15*a* and desirably is surrounded by a cylindrically shaped rubber sleeve 38.

As shown in FIG. 10, the left side pivot pin 38*a* is disposed between the left wheel assembly axle 35*a* and the end 37*a* of the rear wheel axle 37 that is attached to the inner left wheel support 32*b*. In a presently preferred embodiment, the central axis of the left side pivot pin 38*a* is disposed about two inches closer to the closer end of the inner left wheel support 32*b* than the central axis of the left wheel assembly axle 35*a*. Moreover, the central axis of the left side pivot pin 38*a* is disposed about one-quarter inch farther from the lower edge 32*d* of the inner left wheel support 32*b* than is the central axis of the left wheel assembly axle 35*a*. The relative positioning of the right pivot pin 38*b* and the right wheel assembly axle 15*a* in the right wheel support 12 are the mirror images of the corresponding left pivot pin 38*a* and the left wheel assembly axle 35*a* in the left wheel support 32.

As shown in FIGS. 12A and 12B for example, it is important that the pivot pins 38*a*, 38*b* be disposed between the wheel assembly axles 35*a*, 15*a* and the rear end 21 of the trash pump unit 15. With this relative disposition of the pivot pins 38*a*, 38*b* in relation to the respective wheel assembly axles 35*a*, 15*a* and their respective sleeve bearings 18, 17, for the axles 35*a*, 15*a*, when the trash pump unit 15 is resting on all four wheels 34, 33, 14, 13 as in FIGS. 12A and 12B for example, the lowermost surface of the annular rubber sleeve 38 covering each respective pivot pin 38*a*, 38*b* of the left wheel support 32 and the right wheel support 12 respectively, is desirably spaced vertically about three-eighths of an inch above the upper surfaces 24*a*, 23*a* of the corresponding bottom rails 24, 23.

Figure 16A:
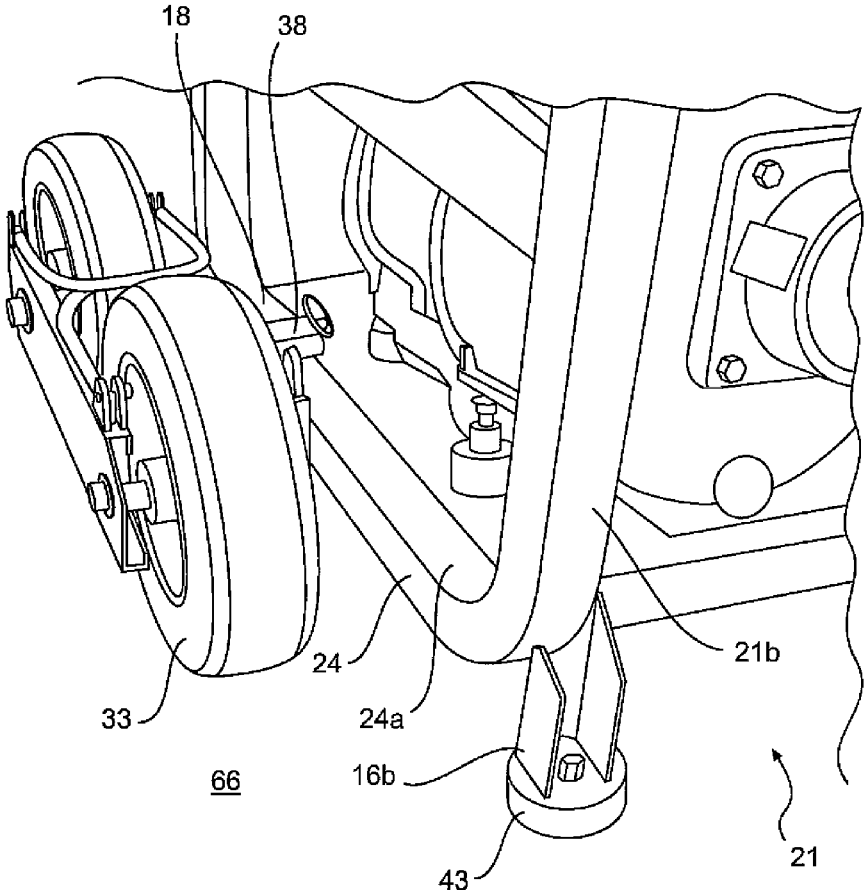
FIG. 16A is an elevated perspective view of assembled components of a presently preferred embodiment of a wheeled, manually movable, internal combustion engine powered air compressor unit of the present invention.
Figure 16B:
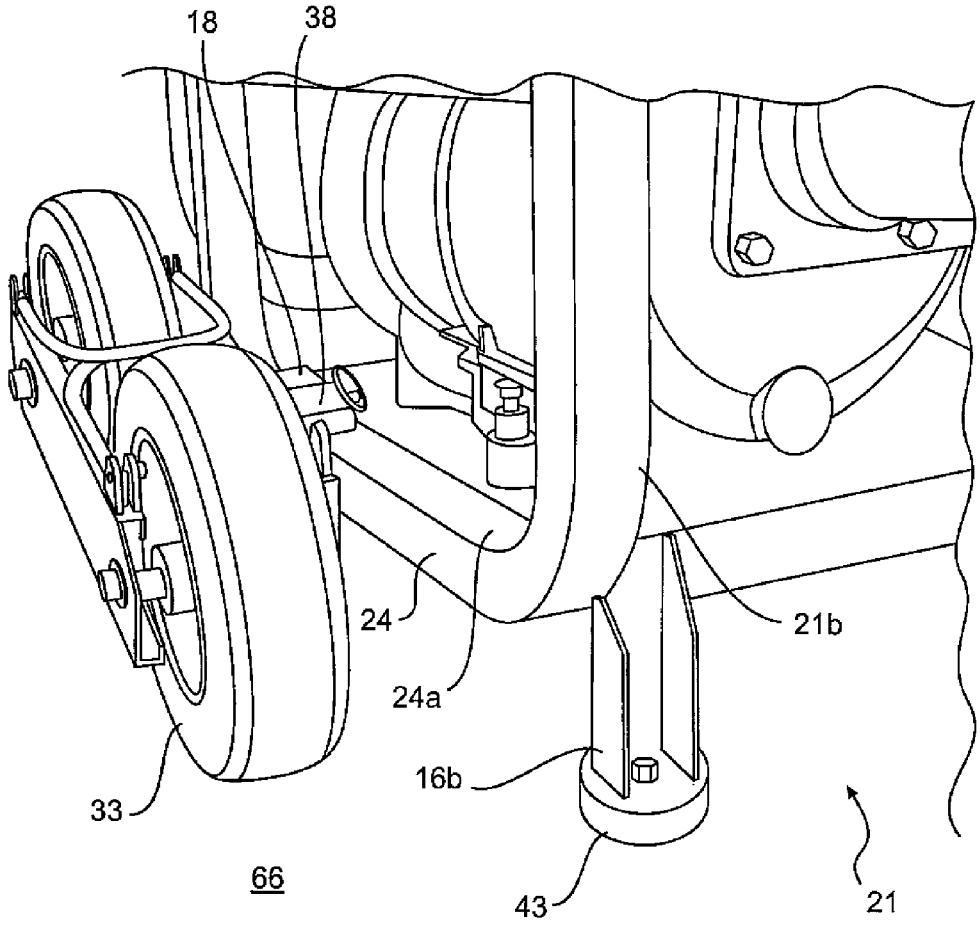
FIG. 16B is an elevated perspective view of assembled components of a presently preferred embodiment of a wheeled, manually movable, internal combustion engine powered air compressor unit of the present invention.

As shown in FIGS. 11, 12A, 12B and 16A for example, with each of the right and left wheel assembly axles 15*a*, 35*a* pivotally mounted in the respective right and left wheel bearings 17, 18, the wheels 33, 34, 13, 14 of each of the wheel assemblies 11, 31 rest on the ground along with each of the rear legs 16*a*, 16*b* of the frame. However, as shown in FIG. 16B for example, when the rear end 21 of the frame of the trash pump unit is lifted vertically away from the ground 66 using the dual rear handles 19*a*, 19*b* (not visible), and before each respective rubber sleeve 38 of each pivot pin 38*a*, 38*b* of the left wheel support 32 and the right wheel support 12 respectively comes into contact with and engages the upper surface 24*a*, 23*a* of the frame's corresponding bottom rail 24, 23, the support cushions 43 on the rear legs 16*a*, 16*b* are lifted off the ground 66 so that only the respective wheels 33, 34, 13, 14 remain in contact with the ground 66. In this way, when being pulled from the rear handle 19, and negotiating a relatively elevated section of the path on the left side of the frame for example, the rear right wheel 13 can rise above the front right wheel 14 and then dip below the front right wheel 14 as the frame moves past the bump in the path while the frame maintains a relatively horizontal orientation during this transition past the bump. Similarly, the rear left wheel 33 can rise above the front left wheel 34 and then dip below the front left wheel 34 as the frame moves past the bump in the path while the frame maintains a relatively horizontal orientation during this relatively easy transition past the bump.

Figure 16C:
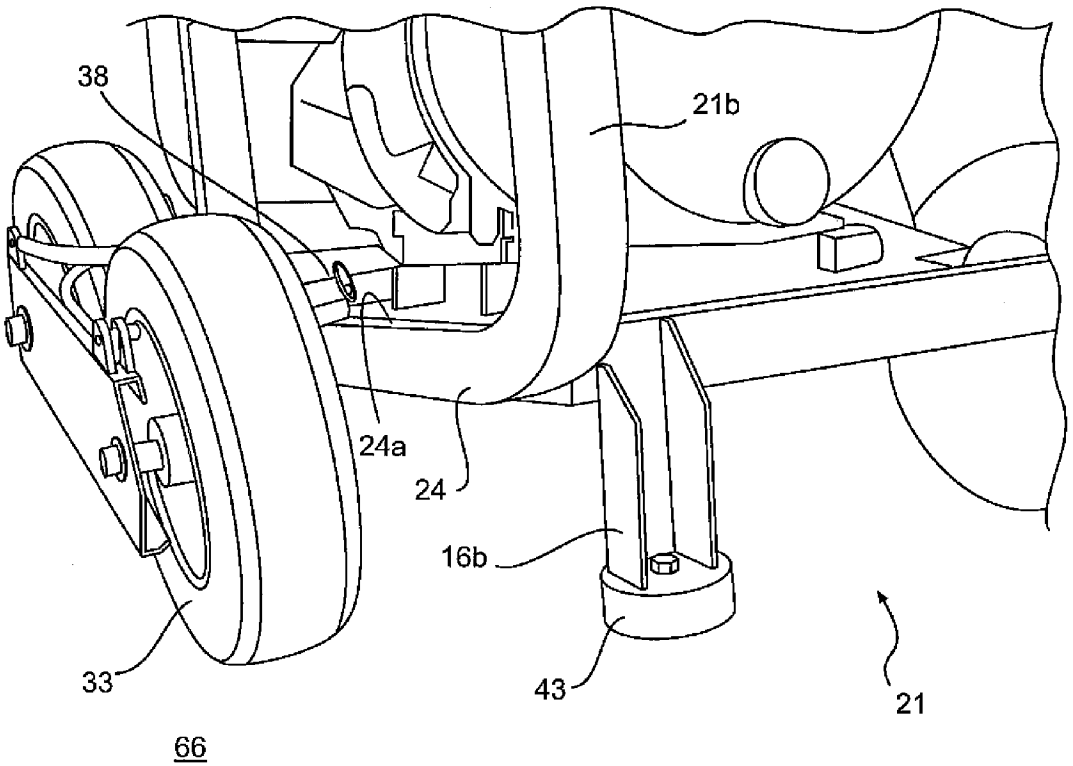
FIG. 16C is an elevated perspective view of assembled components of a presently preferred embodiment of a wheeled, manually movable, internal combustion engine powered air compressor unit of the present invention.

As shown in FIG. 16C for example, only when further lifting of the rear handles 19*a*, 19*b* (not visible) causes each respective rubber sleeve 38 of each pivot pin 38*a*, 38*b* of the left inner wheel support 32 and the right inner wheel support 12 respectively to come into contact with and engage the upper surface 24*a*, 23*a* of the frame's corresponding bottom rail 24, 23, do the rear wheels 33, 13 become lifted away from contact with the ground 66. The upwardly tilted condition of the rear wheels 33, 13 of the trash pump unit 15 is also illustrated in a left side plan view in FIG. 14 and in a right side plan view in FIG. 15. In so lifting the rear wheels 33, 13 off the ground, it becomes easier for the trash pump unit 15 to be pivoted on just the two front end wheels 34, 14 so that the entire trash pump unit 15 can be pivoted from side to side, left or right, on the two front end wheels 34, 14.

As shown in FIG. 3 for example, a retractable front handle 28 is mounted pivotally to the upper portion of the front end 22 of the frame 20. One function of this front handle 28 is to facilitate lifting of the trash pump unit 15 when necessary to negotiate past obstacles that cannot be negotiated solely by using the rear handle 19 to push or pull the trash pump unit 15 on the wheels 13, 14, 33, 34. As shown in FIG. 4, the front handle 28 can be retracted from its extended orientation shown in FIG. 3 to a position in which the front handle 28 lies flush with the front end 22 of the frame 20. As shown in FIG. 3, the front handle 28 can include a right front arm 28*a* that desirably extends parallel to and spaced apart from a left front arm 28*b*. The rear end of the right front arm 28*a* can be pivotally attached to the upper end of the front right upright member 22*a*, and the opposite or front end of the right front arm 28*a* can be connected to or unitary with the right end of an end brace 28*c*. The rear end of the left front arm 28*b* can be pivotally attached to the upper end of the front left upright member 22*b*, and the opposite or front end of the left front arm 28*b* can be connected to or unitary with the left end of an end brace 28*c*. The ability of the front handle 28 to assume the fully retracted position against the front end 22 of the frame 20 facilitates storage of an individual trash pump unit 15 and shipment of multiple trash pump units 15 together.

As shown in the top perspective view of FIG. 1, the frame desirably can include a top cross brace 27 having its opposite ends connected to one of the right top rail 25*a* and the left top rail 25*b*. Though not shown in FIG. 1, an opening desirably is provided vertically through the top cross brace 27, and a threaded nut desirably can be welded to the underside of the top cross brace 27 so that the threaded opening in the nut is concentrically aligned with the opening through the top cross brace 27. The threaded nut also can be provided as a separate element, but in each case the threaded opening in the nut desirably is configured for selectively detachably receiving a threaded end of a bolt portion of a lifting eye fixture 82. The lifting eye fixture 82 facilitates lifting the trash pump unit 15 with a crane. The lifting eye fixture 82 is configured to be selectively detachable by being unscrewed from the threaded opening formed in the nut that attaches the lifting eye fixture 82 to the top cross brace 27 and thus to the frame 20. Detaching the lifting eye fixture 82 facilitates the stacking of one trash pump unit 15 on top of another trash pump unit 15, prior to shipping.

As shown in FIG. 3 for example, a fuel tank 60 for the engine 40 desirably is mounted to the upper portion of the front end 22 of the frame 20 above where the engine 40 rests atop the main floor panel 29 but beneath the frame's top cross brace 27. A fill cap 63 of the fuel tank 60 desirably has a mechanism to lock the cap 63 to the fuel tank 60. The fill cap 63 desirably is disposed below the uppermost elements of the frame 20 such as the top cross brace 27, and thus the upper front portion 22 of the frame 20 houses the fuel tank 60 completely within the outline of the frame 20. The fuel tank 60 desirably has enough capacity to run the engine 40 for up to about two and one half hours, a normal work session, and holds more than two gallons of fuel and desirably holds about 2.3 gallons of gasoline fuel.

As shown in FIGS. 10 and 12B for example, each wheel lock 70 desirably can be provided in the form of a U-shaped rod that has the two free ends. Each of the two free ends of each wheel lock 70 desirably can be opposed to one another and pivotally connected to one of the wheel assemblies. Each U-shaped rod defines an intermediate section disposed between the opposed free ends and the closed loop portion, and the intermediate section desirably is bent at an angle relative to the plane in which the closed loop portion of the U-shaped rod resides. When engaged as a wheel brake, the closed loop portion of the wheel lock 70 contacts the respective rolling surface of the wheel 33, 34 and prevents the respective wheel from rotating in the direction toward the closed loop portion. When both wheel locks 70 are engaged to the respective wheels 33, 34, the left side of trash pump unit 15 is prevented from rolling forward or backward While at least one presently preferred embodiment of the invention has been described using specific terms, such description is for illustrative purposes only, and it is to be understood that changes and variations may be made without departing from the spirit or scope of the invention.

What is claimed is:

1. A wheeled, manually movable, internal combustion engine powered trash pump, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

a pump carried by said frame and connected to said engine;

a first wheel assembly connected pivotally to said first side of said frame and rotatably carrying at least a first wheel;

a second wheel assembly connected pivotally to said second side of said frame and rotatably carrying at least a second wheel; and wherein said first wheel assembly including a first pivot pin extending transversely from said first wheel assembly and disposed to engage said frame and lift one end of said first wheel assembly with respect to the ground when one end of said frame is lifted a predetermined distance above the ground.

2. An apparatus as in claim 1, further comprising:

a first quick-disconnect member selectively connected to said first wheel assembly and configured to selectively permit quickly disconnecting said first wheel assembly from said first side of said frame.

3. An apparatus as in claim 2, wherein said first quick-disconnect member is formed by a cotter pin and said first wheel assembly includes a first wheel assembly axle having a free end defining a hole configured to receive said cotter pin.

4. An apparatus as in claim 1, wherein said first wheel assembly includes a first wheel assembly axle that is pivotally connected to the first side of the frame and the first pivot pin defines a central axis of symmetry that is disposed between the first wheel assembly axle and the rear end of the frame.

5. An apparatus as in claim 1, wherein:

said first wheel assembly including a first front wheel rotatably mounted to said first wheel assembly and a first rear wheel rotatably mounted to said first wheel assembly, said second wheel assembly including a second front wheel rotatably mounted to said second wheel assembly and a second rear wheel rotatably mounted to said second wheel assembly.

6. An apparatus as in claim 5, wherein:

said first front wheel of said first wheel assembly is spaced apart in said axial direction of said frame from said first rear wheel of said first wheel assembly.

7. A wheeled, manually movable, internal combustion engine powered trash pump, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

a pump carried by said frame and connected to said engine;

a first wheel assembly connected pivotally to said first side of said frame and rotatably carrying at least a first wheel;

a second wheel assembly connected pivotally to said second side of said frame and rotatably carrying at least a second wheel; and said first wheel assembly including a first inner wheel support defining an outer side and an inner side disposed opposite said outer side, said first wheel assembly including a front wheel axle extending from said outer side of said first inner wheel support, said first wheel assembly including a rear wheel axle extending from said outer side of said first inner wheel support and spaced apart from said front wheel axle, said first wheel assembly including a first wheel assembly axle extending from said inner side of said first inner wheel support and extending in a transverse direction parallel to said front wheel axle and said rear wheel axle, said first wheel assembly axle being pivotally connected to said first side of said frame;

said second wheel assembly including a second inner wheel support defining an outer side and an inner side disposed opposite said outer side, said second wheel assembly including a front wheel axle extending from said outer side of said second inner wheel support, said second wheel assembly including a rear wheel axle extending from said outer side of said second inner wheel support and spaced apart from said front wheel axle, said second wheel assembly including a second wheel assembly axle extending from said inner side of said second inner wheel support and extending parallel to said front wheel axle and said rear wheel axle, said second wheel assembly axle being pivotally connected to said second side of said frame.

8. An apparatus as in claim 7, wherein:

said first wheel assembly including a first pivot pin extending from said inner side of said first inner wheel support of said first wheel assembly and disposed closer to said rear wheel axle of said first wheel assembly than to said front wheel axle of said first wheel assembly; and said second wheel assembly including a second pivot pin extending from said second inner side of said inner wheel support of said second wheel assembly and disposed closer to said rear wheel axle of said second wheel assembly than to said front wheel axle of said second wheel assembly.

9. An apparatus as in claim 8, wherein:

said first pivot pin is disposed between the first wheel assembly axle and the rear end of the frame and said second pivot pin is disposed between the second wheel assembly axle and the rear end of the frame.

10. An apparatus as in claim 1, further comprising:

a battery carried by said frame and electrically connected to said engine.

11. An apparatus as in claim 1, further comprising:

a first wheel locking mechanism selectively disposable to prevent rotation of said first wheel, said first wheel locking mechanism including a U-shaped rod having two opposed free ends pivotally connected to said first wheel assembly.

12. An apparatus as in claim 1, further comprising:

a rear handle selectively retractably mounted to the rear end of the frame.

13. An apparatus as in claim 1, further comprising:

a front handle selectively retractably mounted to the front end of the frame.

14. An apparatus as in claim 1, further comprising:

at least one top crossbrace extending transversely between said frame's first side and second side; and a lifting eye fixture detachably connected to said top crossbrace.

15. An apparatus as in claim 1, further comprising:

a pair of rear legs connected to said rear end of said frame, a pair of front legs spaced apart from said rear legs and connected to said frame, each of said legs having a free end, and each of said legs being provided with a respective support cushion connected to said respective free end of said respective leg.

16. A wheeled, manually movable, internal combustion engine powered trash pump, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

a pump carried by said frame and connected to said engine;

a first wheel assembly connected pivotally to said first side of said frame and rotatably carrying at least a first wheel;

a second wheel assembly connected pivotally to said second side of said frame and rotatably carrying at least a second wheel; and a pair of rear legs connected to said rear end of said frame, a pair of front legs spaced apart from said rear legs and connected to said frame, each of said legs having a free end, and each of said legs being provided with a respective support cushion connected to said respective free end of said respective leg;

wherein each respective support cushion is formed of resilient, high friction material;

wherein said first wheel assembly including a first pivot pin extending transversely from said first wheel assembly and disposed to engage said frame and lift one end of said first wheel assembly and disposed to engage said frame and lift one end of said first wheel assembly with respect to the ground when one end of said frame is lifted a predetermined distance above the ground.

17. An apparatus as in claim 15, wherein:

said first side of the frame includes a first wheel bearing and said first wheel assembly is connected pivotally to said first side of the frame via said first wheel bearing; and wherein one of said pair of front legs is connected to said first side of said frame at a location between said front end of said frame and said first wheel bearing.

18. A wheeled, manually movable, internal combustion engine powered trash pump, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side, said frame including at least one top crossbrace extending transversely between said frame's first side and second side;

a first wheel assembly and a second wheel assembly, said first wheel assembly being pivotally connected to said first side of said frame and said second wheel assembly being pivotally connected to said second side of said frame;

said first wheel assembly including a first front wheel rotatably mounted to said first wheel assembly and a first rear wheel rotatably mounted to said first wheel assembly, said second wheel assembly including a second front wheel rotatably mounted to said second wheel assembly and a second rear wheel rotatably mounted to said second wheel assembly;

said first wheel assembly including a first quick-disconnect member configured to selectively permit quickly disconnecting said first wheel assembly from said first side of said frame, said second wheel assembly including a second quick-disconnect member configured to selectively permit quickly disconnecting said second wheel assembly from said second side of said frame;

said first wheel assembly including an inner wheel support defining an outer side and an inner side disposed opposite said outer side, said first wheel assembly including a front wheel axle extending from said outer side of said inner wheel support, said first wheel assembly including a rear wheel axle extending from said outer side of said inner wheel support and spaced apart from said front wheel axle, said first wheel assembly including a first wheel assembly axle extending from said inner side of said inner wheel support and extending in a transverse direction parallel to said front wheel axle and said rear wheel axle;

said first wheel assembly including a first pivot pin extending from said inner side of said inner wheel support of said first wheel assembly and disposed closer to said rear wheel axle of said first wheel assembly than to said front wheel axle of said first wheel assembly;

said second wheel assembly including an inner wheel support defining an outer side and an inner side disposed opposite said outer side, said second wheel assembly including a front wheel axle extending from said outer side of said inner wheel support, said second wheel assembly including a rear wheel axle extending from said outer side of said inner wheel support and spaced apart from said front wheel axle, said second wheel assembly including a second wheel assembly axle extending from said inner side of said inner wheel support and disposed symmetrically with respect to said front wheel axle and said rear wheel axle;

said second wheel assembly including a second pivot pin extending from said inner side of said inner wheel support of said second wheel assembly and disposed closer to said rear wheel axle of said second wheel assembly than to said front wheel axle of said second wheel assembly;

a first wheel locking mechanism connected to said first wheel assembly and selectively disposable to prevent rotation of at least one of said first front wheel and said first rear wheel, said first including wheel locking mechanism a first U-shaped rod having two opposed free ends pivotally connected to said first wheel assembly and selectively disposable to prevent rotation of one of said first front wheel or said first rear wheel, said first U-shaped rod having a closed loop portion opposite the two free ends opposed to each other, said first U-shaped rod defining an intermediate section disposed between the opposed free ends and the closed loop portion, said intermediate section being bent at an angle relative to the plane in which the closed loop portion of the U-shaped rod resides;

an internal combustion engine carried by said frame and including a rotatable output shaft;

a battery carried by said frame and electrically connected to said engine;

a pump carried by said frame and connected to said rotatable output shaft of said engine;

a front handle selectively retractably mounted to the front end of the frame; and a rear handle selectively retractably mounted to the rear end of the frame; and a lifting eye fixture detachably connected to said top cross-brace.

* * * * *